United States Patent [19]

Kirkpatrick

[11] Patent Number: 4,982,639

[45] Date of Patent: Jan. 8, 1991

[54] DIE CUTTING ANVIL SYSTEM

[75] Inventor: Alan D. Kirkpatrick, Martinsville, N.J.

[73] Assignee: Robud Company, Pine Brook, N.J.

[21] Appl. No.: 456,582

[22] Filed: Dec. 26, 1989

Related U.S. Application Data

[63] Continuation of Ser. No. 264,458, Oct. 31, 1988, abandoned.

[51] Int. Cl.[5] ..... B26D 7/20

[52] U.S. Cl. ..... 83/659; 83/347

[58] Field of Search ..... 83/659, 347, 348, 698, 83/699, 700; 29/129.5, 130; 101/415.1

[56] References Cited

U.S. PATENT DOCUMENTS

| | | | |
|---|---|---|---|
| 3,180,007 | 4/1965 | Gartz | 29/130 |
| 3,274,873 | 9/1966 | Sauer | 83/347 |
| 3,522,754 | 8/1970 | Sauer | 83/347 X |
| 4,004,479 | 1/1977 | Bodnar | 83/347 X |
| 4,031,600 | 6/1977 | Whigham | 83/659 X |
| 4,073,207 | 2/1978 | Kirkpatrick | 83/659 |
| 4,073,208 | 2/1978 | Kirkpatrick | 83/659 |
| 4,791,846 | 12/1988 | Kirkpatrick | 83/659 |

FOREIGN PATENT DOCUMENTS

| | | | |
|---|---|---|---|
| 2803908 | 8/1979 | Fed. Rep. of Germany | 101/415.1 |

*Primary Examiner*—Douglas D. Watts
*Assistant Examiner*—Rinaldi Rada
*Attorney, Agent, or Firm*—John G. Gilfillan, III

[57] ABSTRACT

A rotary, die cutting anvil system having a rotatable head with a cover mounted on the peripheral surface thereof. The cover includes inner and outer laminated layers. The outer layer is made of a generally tough resilient composition that is softer than the hard inner layer to which it is bonded. The inner layer has holes for receiving pins. The cover is mounted on the head by forcing the pins into the holes. The resilience and shape of the hard inner layer maintains the cover on the anvil until it is pryed off. The pins may be fixed to the anvil head or be fixed on rings or sleeves slidably mounted in grooves on the periphery of the anvil head to permit linear or oscillatory freewheeling.

11 Claims, 3 Drawing Sheets

DIE CUTTING ANVIL SYSTEM

This application is a continuation of U.S. application Ser. No. 07/264,458, filed on 10-31-88, now abandoned.

BACKGROUND OF THE INVENTION

This invention pertains generally to die cutting. More specifically, this invention relates to anvil covers for use in conjunction with die cutting apparatus.

In the rotary die cutting art, rotary anvil constructions employ covers of tough resilient material, such as rubber, synthetic rubber, polyurethane, and the like, against which the cutting dies work. U.S. Pat. Nos. 3,522,754; 4,073,208; 3,282,142; 3,274,873; and 4,073,207 disclose a number of typical rotary anvil constructions. These patents also disclose several variations of removable anvil covers. The primary function of these covers is to provide a relatively tough uniform surface against which the sharp blade of a die cutter will work when cutting thin sheets or webs such as cardboard, corrugated paper or the like. To be of practical use, such removable covers should be relatively long lasting, inexpensive to manufacture, readily restorable or cheap enough to be disposable, and easy to mount and remove so as to avoid excessive downtimes during replacement.

Those concerned with the development of such removable anvil covers have long recognized that long cover life is best achieved when the cover provides a uniform resistance to the cutter penetration during operation. As can been seen from the above cited patents, attempts to develop such long lasting, easily replaceable anvil covers have included cover and anvil combinations with ribs, grooves, reinforcing materials, interlocking lugs, recesses, and a variety of other complex mounting structures. Although prior art cover structures have resulted in some success at providing more uniform cutting surfaces, thereby increasing cover life, many have been unduly complex. As such, many prior art covers have proved to be relatively expensive to manufacture and often cumbersome to use. For example, it is generally felt that many available covers are unduly time consuming for an operator to mount or replace when worn, thereby resulting in unnecessary downtime. Additionally, many prior art covers have been found to be so complex that users desiring to incorporate them into their present equipment normally have to bear the enormous expense of replacing the entire drum-anvil-cover combination.

SUMMARY OF THE INVENTION

The general purpose of this invention is to provide an anvil-cover system which embraces all of the advantages of similarly employed prior art devices and possesses none of the aforedescribed disadvantages. To attain this, the present invention contemplates a unique anvil-cover system that has a firm, uniform, long-wearing cutting surface that is easily mounted and removed from an anvil head. Moreover, the cover is inexpensive to manufacture and readily replaceable by a user. More particularly, the invention includes a laminated anvil cover having a cutting layer joined to a mounting layer having mounting holes that cooperate with mounting pins which are operably connected to an anvil drum. As such, the cover is mounted on the drum by the simple operation of inserting the pins in holes provided in the cover. Additionally, the mounting pins are constructed to be readily incorporated in or cooperate with conventional structures presently used in the industry.

It is, therefore, an object of the present invention to provide an easily replaceable anvil cover.

Another object is to provide an anvil-cover combination that will result in an increase in cover life.

A further object of this invention is to provide an anvil cover that can be used to retrofit a variety of prior art devices.

Other objects and advantages of the invention will hereinafter become more fully apparent from the following detailed description when read in view of the annexed drawings, which illustrate a preferred embodiment, and wherein:

DETAILED DESCRIPTION OF PREFERRED EMBODIMENTS

Figure 1:
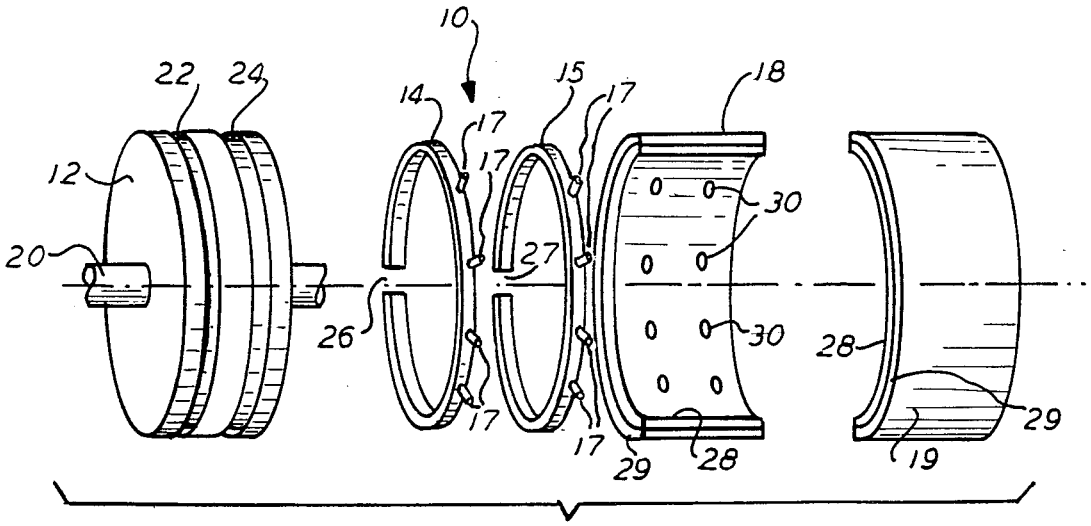
FIG. 1 is an exploded, perspective view of a first embodiment of the invention.
Figure 2:
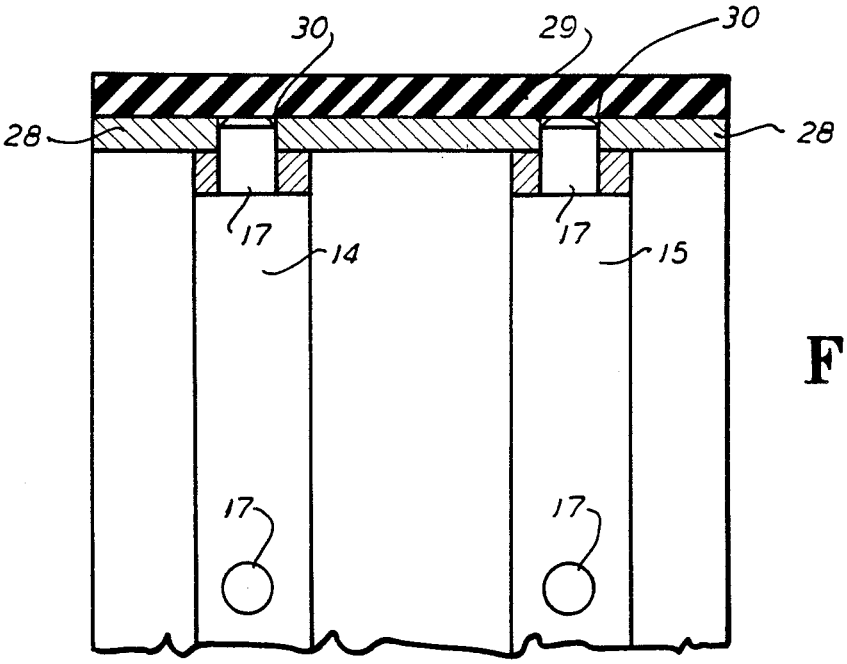
FIG. 2 is a partial sectional view of a portion of the embodiment shown in FIG. 1.
Figure 3:
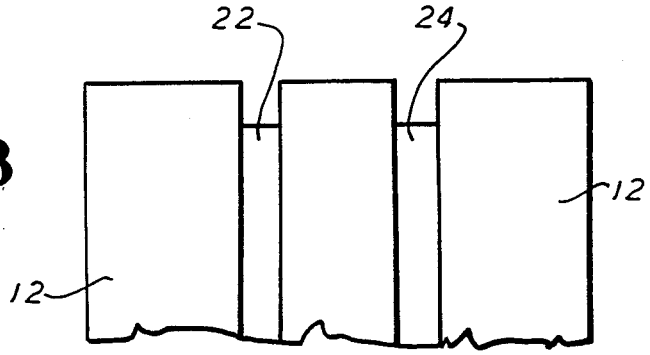
FIG. 3 is a partial elevation view of a portion of the embodiment shown in FIG. 1.

Referring now to the drawings, wherein like reference characters designate like or corresponding parts throughout the several views, there is shown in FIGS. 1–3 a freewheeling, rotary, die cutting anvil system 10 having a cylindrical anvil head 12, a pair of similar split mounting rings 14, 15, and cover half sections 18, 19. Head 12 is mounted on a shaft 20 for rotation therewith. Formed in the circumferential surface of head 12 are a pair of spaced circumferential slots 22, 24. The FIG. 1 configuration of head 12 includes the basic structure of a typical prior art head, i.e. a cylindrical drum with one or more circumferential slots mounted on a rotatble shaft. This basic structure is found in many systems whether or not the anvil covers are freewheeling or non-freewheeling. The typical slots, usually used to mate with ribs integral with a cover, may be numerous or few, and of complex cross-sectional shape or of simple rectangular cross-sectional shape as are slots 22, 24.

As noted above, circumferential slots 22, 24 are adapted to receive therein mounting rings 14, 15, respectively. In the embodimewnt of FIGS. 1–3, rings 14, 15 are slidably received within their respective slots 22, 24 such that during use of the system the rings 14, 15 and therewith cover sections 18, 19 may rotate relative to anvil head 12. Further, in the embodiment shown, rings 14, 15 are manufactured of resilient material and are split as at 26, 27 so that during assembly the rings may be spread for passage over the surface of head 12 and the snap back into cylindrical shape when received within their respective slots 22, 24. Each mounting ring 14, 15 is provided with a plurality of radially outwardly extending pins 17 which are arcuately spaced around the rings 14, 15. As is discussed below, rings 14, 15 can be defined by half sections in which case they would be retained within slots 22, 24 by the cooperative retaining action of the anvil cover sections 18, 19.

Cover half sections 18, 19 are identical and are each composed of laminated inner and outer layers 28, 29, respectively. Outer layer 29 is made of a suitable material for use as a cutting surface against which a cutting element works. Examples of suitable materials are polyurethane, rubber, synthetic rubber and the like. The inner layer 28 is made of a hard, resilient material such as plastic or metal having spaced holes 30 of a size and spacing to receive pins 17. The inner surface of inner layers 28 and the outer surface of drum 12 have substantially equal radii of curvature.

The cover half sections 18, 19 are mounted on the head 12 by first aligning the holes 30 with the pins 17 and then forcing the cover sections 18, 19 onto the pins 17. Because the cover sections 18, 19 have radii of curvature substantially equal to the outside surface of head 12 and the ends of pins 17 lie on a surface having a slightly larger radius of curvature, the holes 30 will not normally all be exactly aligned with the pins 17. Therefore, the cover sections 18, 19, when forced on the pins 17, must first be slightly flexed to assume a larger radius of curvature to effect alignment of the pins 17 and holes 30. After the pins 17 and holes 30 become aligned and engaged, the cover sections 18, 19 will return to their original shape due to their resilience thereby becoming tightly forced against the outer surface of head 12 as the pins 17 nestle in holes 30. Mounting the cover sections 18, 19 on the head 12 may be performed quickly by using a rubber mallet or the like to drive the cover sections 18, 19 onto pins 17 with a few sharp blows of the mallet.

All that is necessary to remove the cover sections 18, 19 from head 12 is to simply decouple the holes 30 and pins 17. This operation can be performed quickly by prying the cover from the head 12 with a leaver, such as a crowbar or jimmy, wedged between the head 12 and the cover sections 18, 19. It is preferred that the outer diameter of pins 17 and the diameter of holes 30 be substantially equal. Differences in these diameters should be kept to a minimum so that the pins 17 will maintain the cover in tight engagement with head 12 as shown in FIG. 2.

With the cover sections 18, 19 mounted on the pins 17, the rings 14, 15 are free to slide in the slots 22, 24, thereby permitting the cover sections 18, 19 to freewheel on the head 12 in a manner well known to those skilled in these arts. It should be clear to the artisan that this embodiment (FIGS. 1–3) is well suited for use in retrofitting existing conventional freewheeling and non-freewheeling rotary die cutting structures having circumferential slots similar to slots 22, 24.

Although the FIGS. 1–3 cover is shown as composed of two cover half sections 18, 19, a one-piece cover with a split section, similar to the split section 26 of ring 14, could also be employed. A one-piece cover would have to be sufficiently flexible to permit it to be mounted on the head 12 in the same manner as are rings 14, 15. Likewise, as another alternative, the rings 14, 15 could each be made of two or more sections in the same manner as are the anvil cover sections 18, 19. Of course, in general, the least number of cover sections 18, 19 that are used the more uniform will be the cutting surface and the more potential there will be for a longer cover life. Also, in general, the fewer the number of ring sections and cover sections the less complex will be the mounting procedure, thereby reducing downtime when worn cover sections 18, 19 are to be replaced.

Figure 4:
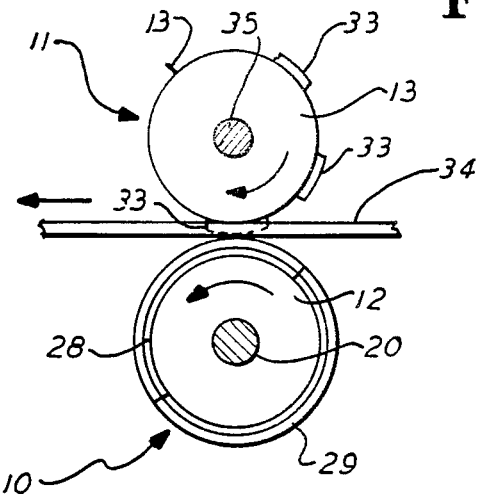
FIG. 4 is an elevational view of a system in which the various embodiments are used.

FIG. 4 shows the present invention incorporated in a typical rotary dye cutting apparatus 11 having an anvil 10, a cutting roller 13, and a web 34 of a material to be cut, e.g. a web of corrugated paper. The cutting roller 13 is driven clockwise by a drive shaft 35. A set of three spaced cutting knives or rules 33, selectively mounted on the surface of roller 13, cut the web 34 in a desired configuration. The anvil head 12 rotates counterclockwise about the axis of shaft 20. The anvil cover, having inner and outer layers 28, 29 is schematically shown mounted on head 12 with the outer layer 29 providing a working reaction surface for rules 33 as they cut and penetrate the web 34. In the case where anvil 10 is a non-freewheeling apparatus, the head 12 and layers 28, 29 will be fixed to each other and have the same rotational speed. In the situation where anvil 10 is a freewheeling apparatus, the head 12 and layers 28, 29 will have different rotational velocities dictated by the nature of the particular freewheeling structure employed. In a typical system, the head 12 and roller 13 are made to have angular velocities such that the outer surface of layer 29, the cutting edges of the cutting rules 33 and the web 34 have substantially the same linear velocity so that the rules 33 appear to be moving only radially with respect to the outer layer 29 at the point of contact between rule 33, web 34 and layer 29.

In the freewheeling structure of FIGS. 1–3 the rings 14, 15 are slidably contained in slots 22, 24, thereby permitting layers 28, 29 to slidably rotate longitudinally with respect to the head 12. As such, there will be intermittant slight relative rotational movements between the cover and the head 12 caused by the impacts of the rules 33 when they contact the web 34 and layer 29. This so-called freewheeling feature permits the layers 28, 29 to have a slightly different and somewhat random movement with respect to the rules 33, thereby increasing cover lifetime by avoiding repetative contacts at the same locations on layer 29 by rules 33.

Figure 5:
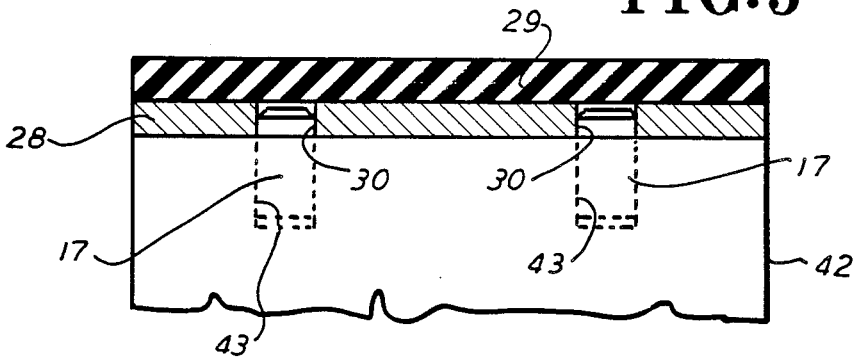
FIG. 5 is a partial sectional view, similar to the view of FIG. 2, of a second embodiment of the invention.
Figure 6:
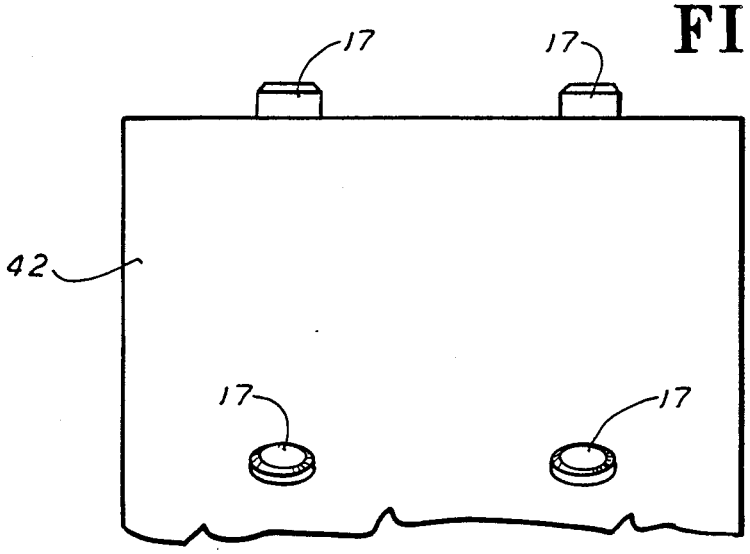
FIG. 6 is a partial elevation view, similar to the view of FIG. 3, of a portion of the second embodiment.

FIGS. 5–6 illustrate a non-freewheeling head 42 wherein the pins 17 are mounted in bores 43 formed in the outside surface of head 42 and extend radially therefrom a distance substantially equal to the depth of holes 30 in layer 28. As can be seen from comparison with FIGS. 1–3, the only structural difference between these embodiments is that pins 17 in the freewheeling structures (FIGS. 1–3) are mounted to permit relative movement between the cover sections 18, 19 and the head 12, while in the non-freewheeling structure (FIGS. 5–6) no such relative movement is provided because the pins 17 are fixed in head 42.

Virtually any existing anvil structure could be readily modified to incorporate the non-freewheeling principle by simply mounting pins 17 to extend radially from the surface of the anvil. On the other hand, the freewheeling structure of FIGS. 1–3 can be incorporated in any one of the many existing freewheeling and non-freewheeling structures having circumferential slots or similar structures in which a pin-carrying ring or rings may be slidably mounted.

Figure 7:
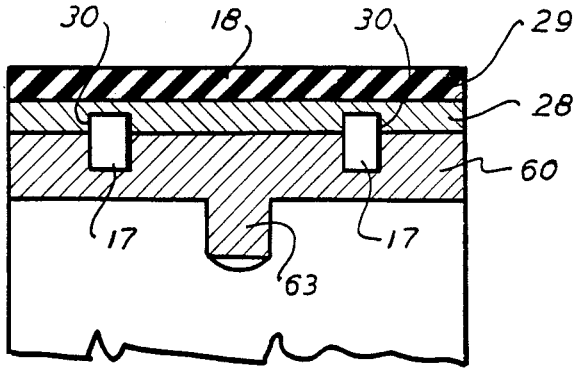
FIG. 7 is a partial sectional view, similar to the views in FIGS. 2, 5, of a third embodiment of the invention.
Figure 8:
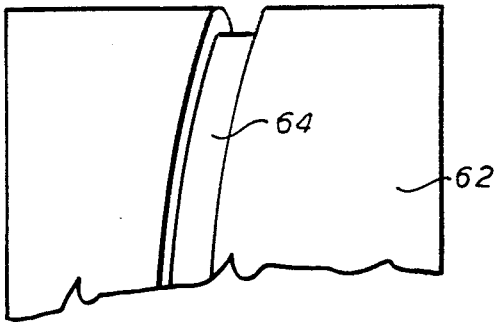
FIG. 8 is a partial, elevation view, similar to the views of FIGS. 3, 6, of a portion of the third embodiment.

FIGS. 7–8 illustrate an oscillating, freewheeling structure. Anvil head 62 has a continuous slot 64 formed in the periphery thereof. Slot 64 is arranged on head 62 such that its distance from the sides of head 62 varies. As such, a freewheeling cover mounted on head 62 and guided by slot 64 will move longitudinally around the surface of head 62 and also will oscillate on head 62 in a direction transverse to the direction of movement of head 62. One preferred arrangement of slot 64 is for the slot 64 to lie in a plane that is slightly tilted with respect to the surface of head 62.

A cylindrical bearing sleeve 60 has an integral pin 63 extending radially inwardly from the inside surface thereof. Sleeve 60 also has spaced pins 17 mounted thereon that extend radially outwardly from the outside surface thereof. A cover half section 18 having an outer layer 29, an inner layer 28 and spaced holes 30 is shown mounted on sleeve 60. The single pin 63 on sleeve 60 is dimensioned to fit snugly in slot 64 and slide therein. The sleeve 60 is a hard, resilient, cylinderical structure and functions in a manner similar to the rings 14, 15 (FIG. 1). Sleeve 60 carries a plurality of pins 17 that are sufficiently spaced to permit the mounting of cover sections 18, 19 thereon (only cover section 18 is shown in FIG. 7). The sleeve 60 may be split, in a manner similar to the split section 26, 27 in rings 14, 15 of FIG. 1, to permit mounting of the sleeve 60 on head 62. The sleeve 60, like rings 14, 15, is meant to be a permanent working part of head 62.

Once the sleeve 60 is mounted on head 62, the cover half sections 18, 19 are mounted and removed in the same fashion as described with respect to the mounting and removal of sections 18, 19 in the FIG. 1 embodiment.

The operation of the oscillating, freewheeling structure is similar to the operation of the FIG. 1 device in the sense that the sleeve 60 normally rotates with the anvil head 62 except during short freewheeling periods when the sleeve 60 will move longitudinally on head 62 as the result of the knives or rules 33 impacting outer layer 29. Because the slot 64 lies in a tilted plane, the single pin 63 will cause the sleeve 60 to move transversely on head 62 during these freewheeling periods. As such, the impacts of rules 33 will be distributed over a larger area on the surface of outer layers 29 than in the case of the simple freewheeling structure of FIG. 1, thereby further increasing cover lifetime.

Figure 9:
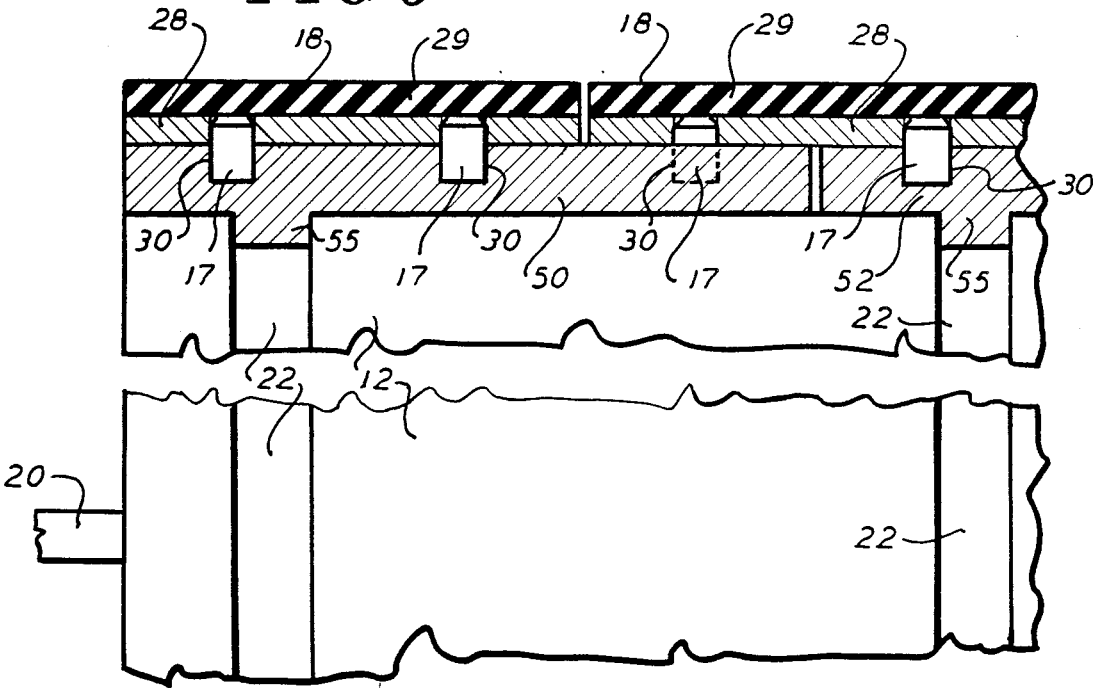
FIG. 9 is a partial, sectional view, similar to the views of FIGS. 2, 5, 7 of a fourth embodiment of the invention.

FIG. 9, illustrating still another embodiment, shows a plurality of cover sections 18 mounted side-by-side on a common anvil head 12. In FIG. 9, the cover is depicted in cross section showing inner and outer layers 28, 29, respectively. A first bearing sleeve 50 carries a plurality of radially outwardly extending pins 17 fixed within bores 30 in the outer surface thereof. The pins 17 extend a distance from the sleeve 50 substantially equal to the depth of holes 30 in inner layer 28. A second bearing sleeve 52 is mounted on anvil 12 transversely adjacent sleeve 50. The sleeve 52 and cover section 18 mounted thereon are broken away on the right to depict that a plurality of such cover sections 18 and bearing sleeves 50, 52 greater than the two shown may be employed. Also, although other variations are clearly possible, the bearing sleeve 50 is shown as completely supporting a first cover section 18 and a portion of a second cover section 18. Bearing sleeve 52 is shown as also supporting a portion of the second cover section 18. Of course, at this point it will become evident to those skilled in these arts that the number of cover sections and bearing sleeves is arbitrary and may vary from one to a substantial plurality. The anvil head 12 is provided with circumferentially extending grooves 22. Formed on the inner surfaces of sleeves 50, 52 are radially inwardly extending pins 55 which are slidably received within grooves 22.

Pins 55 may be single lugs having diameters or widths which are substantially equal to the width of grooves 22, or alternatively, they can be formed as ridges extending completely around the anvil 12, similar in shape and function to ring 14 of FIG. 1.

Thus, the entire unit, including cover sections 18 and bearing sleeves 50, 52, will freewheel on the anvil head 12 as a unit. The anvil head 12 may include a plurality of circumferential grooves 22 while bearing sleeves corresponding in number to the grooves will include a similar number of pins 55 or other protrusions in the form of lugs, ridges, etc. that will slide in groove 22 and any additional grooves that may be provided.

Each of the bearing sleeves 50, 52 may be made as a single piece or as several sections. If made as a single piece, similar to ring 14 of FIG. 1, it would have a split section similar to split section 26 in FIG. 1 and be sufficiently flexible to effect mounting on anvil head 12. Alternatively, each sleeve 50, 52 may be made of two or more sections to be circumferentially placed on anvil head 12 as are the cover sections 18, 19 of FIG. 1. When made of several sections, the cover sections 18 should be placed so as to overlap the sleeves 50, 52 to insure that they are held firmly against the surface of anvil head 12. In this latter case, it is important that a sufficient number of pins 17 be distributed on the surface of sleeves 50, 52 and that the cover sections 18 have a similar number of properly spaced, mating holes 30. The sleeves 50, 52 may be fabricated of plastic, metal or other suitable material readily accessable to those skilled in these arts.

In all of the embodiments shown, the inner and outer layers 28, 29 work as a unit to provide a relatively tough, uniform cutting surface. The inner layer 28, made of relatively hard material, is bonded to the much softer outer layer 29. Because of this bond, relative movement between the flexible cutting layer 29 and the hard backing layer 28 on which it is supported is eliminated thereby preventing unwanted stretching or distortion of the flexible layer 29.

Obviously, other modifications and variations of the present invention are possible in the light of the above teachings. It is therefore to be understood that, within the scope of the apended claims, the invention may be practiced otherwise than as specifically described.

What is claimed is:

1. A rotary anvil comprising:

an anvil head suitable for mounting on a rotatable shaft and having a peripheral surface;

a laminated cover having inside and outside superimposed layers bonded to each other over a major portion of their adjacent surfaces;

said inside layer being made of a relatively hard, resilient material;

said outside layer being made of a relatively soft, resilient material; and means for coupling said cover to an anvil, said means including a plurality of spaced holes formed in said inside layer, said holes for receiving pins which cooperate with said holes for coupling said cover to said anvil, said means for coupling causes said cover to be slidably secured for longitudinal and transverse movement with respect to said anvil head.

2. A rotary anvil comprising:

an anvil head suitable for mounting on a rotatable shaft and having a peripheral surface;

a laminated cover having inside and outside superimposed layers bonded to each other over a major portion of their adjacent surfaces;

said inside layer being made of a relatively hard, resilient material;

said outside layer being made of a relatively soft, resilient material; and means for coupling said cover to an anvil, said means including a plurality of longitudinally spaced holes formed in said inside layer, said holes for receiving pins which cooperate with said holes for coupling said cover to said anvil.

3. A rotary anvil according to claim 2 wherein said inside layer is sufficiently resilient to be flexed such as to permit entry of said pins into said spaced holes.

4. A rotary anvil according to claim 2 wherein said means for coupling causes said cover to be rigidly secured with respect to said peripheral surface of said anvil head.

5. A rotary anvil according to claim 2 wherein said means for coupling causes said cover to be slidably secured with respect to said peripheral surface of said anvil head.

6. A rotary anvil according to claim 2 wherein said means for coupling includes a plurality of pins mounted on said anvil head, said pins being slidably received within said spaced holes.

7. A rotary anvil according to claim 6 wherein said pins are slidably mounted on said anvil head.

8. A rotary anvil according to claim 2 including a sleeve disposed between said inside layer and said peripheral surface of said anvil head, and wherein said means for coupling includes a plurality of pins mounted on said sleeve, said pins being slidably received within said spaced holes.

9. A rotary anvil according to claim 8 wherein said sleeve is slidably mounted on said peripheral surface.

10. A rotary anvil cover comprising:

a cylindrical laminate having inside and outside superimposed layers bonded to each other over at least a major portion of their adjacent surfaces;

said inside layer being made of a relatively hard, resilient material;

said outside layer being made of a relatively soft, resilient material; and means for coupling said cover to an anvil, said means including a plurality of longitudinally spaced holes formed in said inside layer, said holes for receiving pins mounted on said anvil which cooperate with said holes for coupling said cover to said anvil.

11. A rotary anvil cover according to claim 10 wherein said inside layer is sufficiently resilient to be flexed such as to permit entry of said pins into said spaced holes.

* * * * *